US011026861B2

(12) United States Patent
Paniccia

(10) Patent No.: US 11,026,861 B2
(45) Date of Patent: Jun. 8, 2021

(54) PHYSICAL THERAPY DEVICE

(71) Applicant: Michael Paniccia, Tamarac, FL (US)

(72) Inventor: Michael Paniccia, Tamarac, FL (US)

( * ) Notice: Subject to any disclaimer, the term of this patent is extended or adjusted under 35 U.S.C. 154(b) by 184 days.

(21) Appl. No.: 16/417,707

(22) Filed: May 21, 2019

(65) Prior Publication Data

US 2019/0269573 A1 Sep. 5, 2019

(51) Int. Cl.
*A61H 15/00* (2006.01)
*A61H 1/02* (2006.01)

(52) U.S. Cl.
CPC ..... *A61H 15/00* (2013.01); *A61H 1/0237* (2013.01); *A61H 2015/0014* (2013.01); *A61H 2201/0119* (2013.01); *A61H 2201/1253* (2013.01)

(58) Field of Classification Search
CPC ..... A61H 15/00; A61H 1/0237; A61H 2201/1253; A61H 2201/0119; A61H 2015/0014; A61H 2201/0173; A61H 2201/1284; A61H 2201/1671; A61H 2201/169; A61H 7/007; A61H 2203/03; A61H 2205/10; A61H 2201/0192; A61H 2201/164; A61H 1/00
See application file for complete search history.

(56) References Cited

U.S. PATENT DOCUMENTS 1,322,720 A 11/1919 Noble
1,748,425 A 2/1930 Odell
3,759,250 A 9/1973 Salata
4,193,394 A 3/1980 Everett
4,411,421 A * 10/1983 Hershberger ..... A61H 15/00 482/132
5,573,485 A 11/1996 Geschwender
5,643,182 A * 7/1997 Engel ..... A61H 15/0092 601/119
7,121,985 B2 10/2006 Cheng
7,534,200 B1 * 5/2009 Martinez ..... A63B 21/00047 482/142
D613,804 S 4/2010 Perez
8,801,579 B2 8/2014 Beck
9,623,283 B2 * 4/2017 Vallo ..... A63B 22/20
10,039,690 B2 8/2018 Kramer
2010/0063429 A1 * 3/2010 McClorey ..... A61H 15/00 601/122
2010/0145240 A1 6/2010 Cromie
2011/0040219 A1 * 2/2011 Tanner ..... A61H 1/0292 601/128
2011/0077560 A1 * 3/2011 Jacofsky ..... A61H 1/008 601/5

(Continued)

*Primary Examiner* — Andrew S Lo
(74) *Attorney, Agent, or Firm* — Kyle A. Fletcher, Esq.

(57) ABSTRACT

The physical therapy device is a therapeutic device. The physical therapy device is adapted for use with a patient. The physical therapy device massages a leg of the patient. The physical therapy device comprises a base, a plurality of telescopic stanchions, and a massaging structure. The massaging structure and the base attach to the plurality of telescopic stanchions. The plurality of telescopic structures elevate the massaging structure above a supporting surface. The massaging structure rotates such that the rotation of the massaging structure massages the leg of the patient. The base is a pedestal that forms the final link in the load path between the massaging structure and a supporting surface.

18 Claims, 4 Drawing Sheets

(56) References Cited

U.S. PATENT DOCUMENTS

| | | | | |
|---|---|---|---|---|
| 2011/0118095 | A1* | 5/2011 | Perry, Jr. | A63B 23/0233 482/142 |
| 2013/0035217 | A1* | 2/2013 | Beck | A63B 21/4033 482/79 |
| 2014/0342886 | A1* | 11/2014 | Beck | A63B 23/04 482/132 |
| 2015/0111707 | A1* | 4/2015 | Yan | A63B 21/4025 482/78 |
| 2015/0257969 | A1* | 9/2015 | Shannon | A61H 15/00 601/121 |
| 2016/0058656 | A1* | 3/2016 | Harvel | A61H 15/0092 601/122 |
| 2016/0129302 | A1* | 5/2016 | Vallo | A61H 1/0292 482/132 |
| 2017/0290730 | A1* | 10/2017 | Smith | A61H 3/04 |
| 2019/0060153 | A1* | 2/2019 | Mangino, Jr. | A61H 1/02 |
| 2020/0368101 | A1* | 11/2020 | Nash | A61H 15/00 |

* cited by examiner

PHYSICAL THERAPY DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including physical therapy apparatus, more specifically, a massage apparatus comprising rollers. (A61H15/00)

SUMMARY OF INVENTION

The physical therapy device is a therapeutic device. The physical therapy device is adapted for use with a patient. The physical therapy device massages a leg of the patient. The physical therapy device comprises a base, a plurality of telescopic stanchions, and a massaging structure. The massaging structure and the base attach to the plurality of telescopic stanchions. The plurality of telescopic structures elevate the massaging structure above a supporting surface. The massaging structure rotates such that the rotation of the massaging structure massages the leg of the patient. The base is a pedestal that forms the final link in the load path between the massaging structure and a supporting surface.

These together with additional objects, features and advantages of the physical therapy device will be readily apparent to those of ordinary skill in the art upon reading the following detailed description of the presently preferred, but nonetheless illustrative, embodiments when taken in conjunction with the accompanying drawings.

In this respect, before explaining the current embodiments of the physical therapy device in detail, it is to be understood that the physical therapy device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the physical therapy device.

It is therefore important that the claims be regarded as including such equivalent construction insofar as they do not depart from the spirit and scope of the physical therapy device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
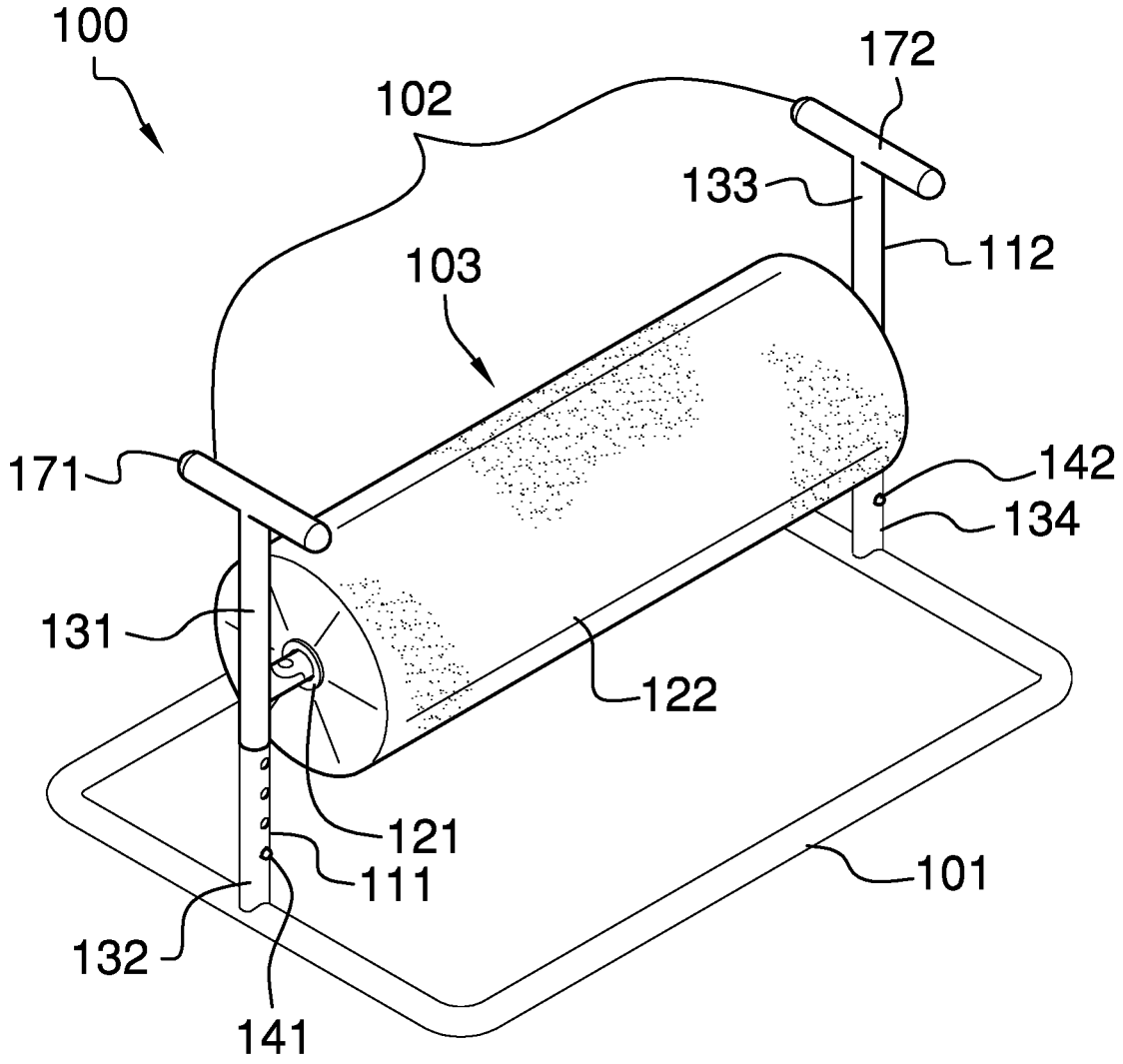
FIG. 1 is a perspective view of an embodiment of the disclosure.
Figure 2:
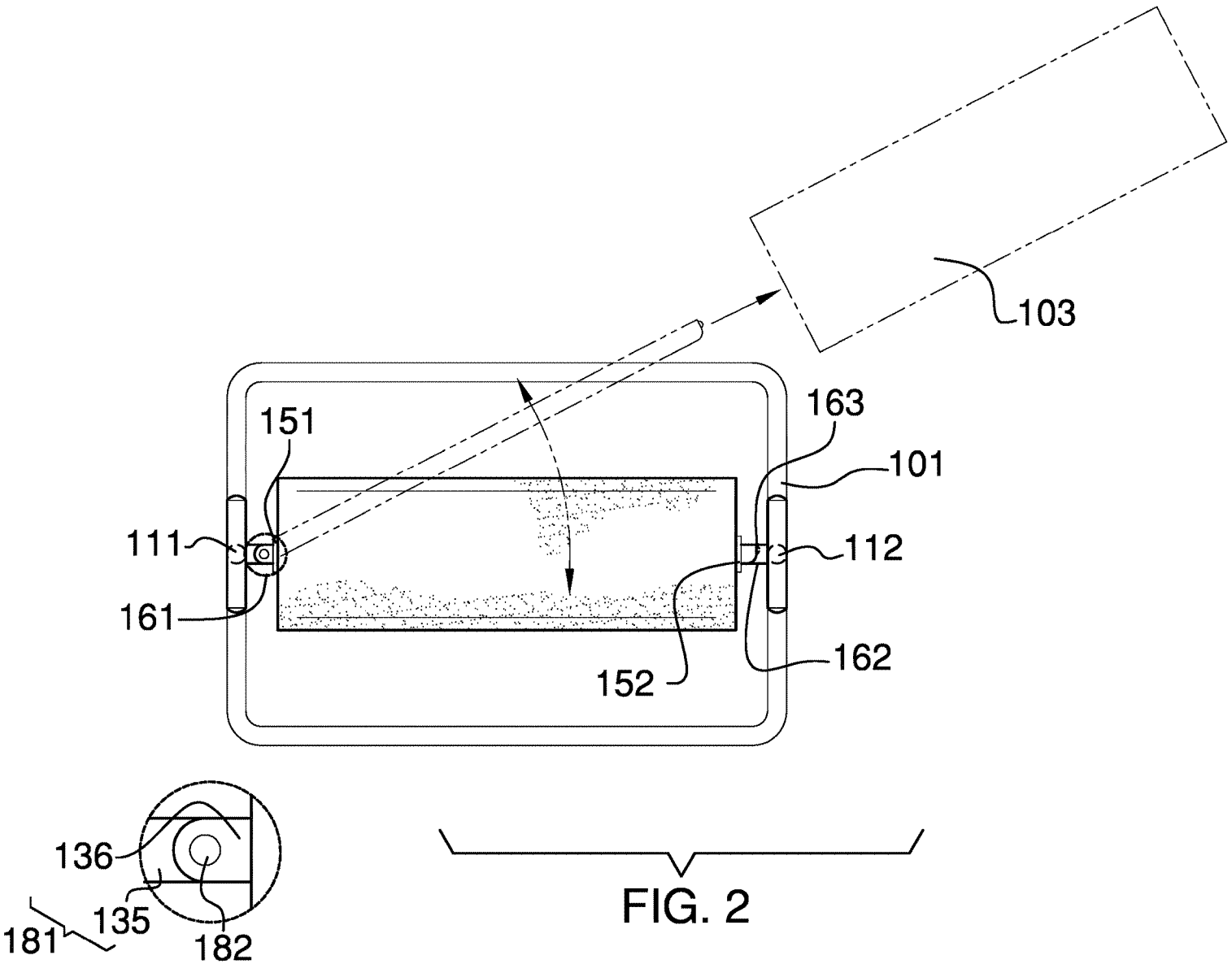
FIG. 2 is a top view of an embodiment of the disclosure.
Figure 3:
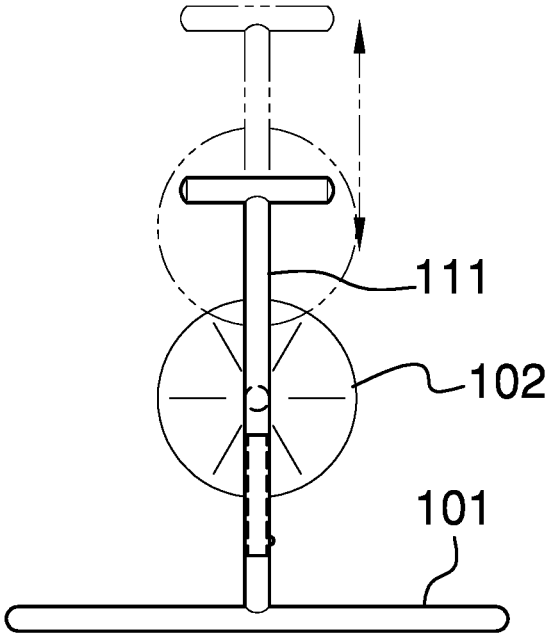
FIG. 3 is a side view of an embodiment of the disclosure.
Figure 4:
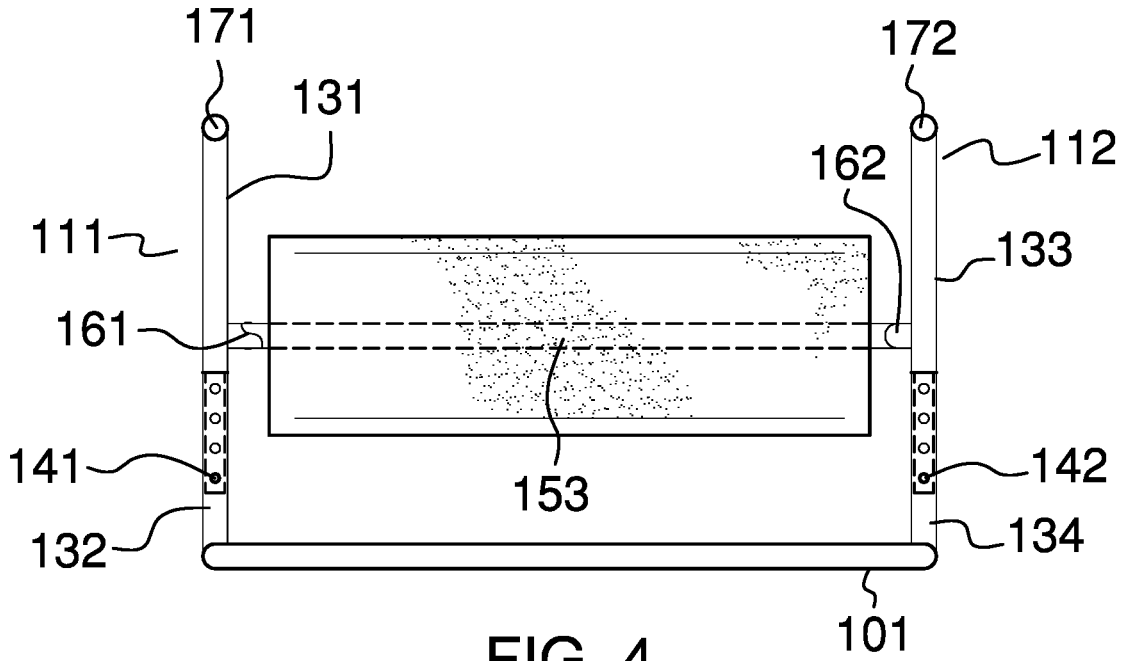
FIG. 4 is a front view of an embodiment of the disclosure.
Figure 5:
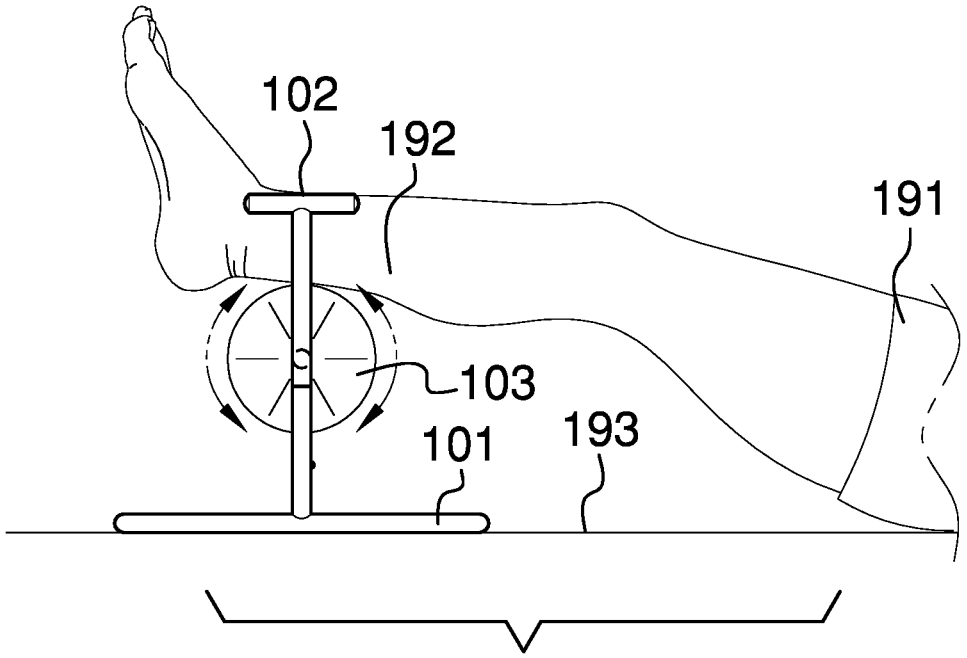
FIG. 5 is an in-use view of an embodiment of the disclosure.

Detailed reference will now be made to one or more potential embodiments of the disclosure, which are illustrated in FIGS. 1 through 5.

The physical therapy device 100 (hereinafter invention) is a therapeutic device. The invention 100 is adapted for use with a patient 191. The invention 100 massages a leg 192 of the patient 191. The invention 100 comprises a base 101, a plurality of telescopic stanchions 102, and a massaging structure 103. The massaging structure 103 and the base 101 attach to the plurality of telescopic stanchions 102. The plurality of telescopic stanchions 102 elevate the massaging structure 103 above a supporting surface 193. The massaging structure 103 rotates such that the rotation of the massaging structure 103 massages the leg of the patient 191. The base 101 is a pedestal that forms the final link in the load path between the massaging structure 103 and a supporting surface 193.

The patient 191 is defined elsewhere in this disclosure. The leg 192 is an appendage of the patient 191. The term appendage is defined elsewhere in this disclosure. The supporting surface 193 is defined elsewhere in this disclosure.

The base 101 is a pedestal. The base 101 forms the final link of the load path between the massaging structure 103 and the supporting surface 193. The base 101 is an openwork structure. In the first potential embodiment of the disclosure, the base 101 has a rectangular shape.

The plurality of telescopic stanchions 102 is an extension apparatus. The plurality of telescopic stanchions 102 elevates the position of the massaging structure 103 above the supporting surface 193. Each of the plurality of telescopic stanchions 102 is identical. Each of the plurality of telescopic stanchions 102 is a composite prism structure. Each telescopic structure selected from the plurality of telescopic stanchions 102 is adjustable such that the span of the length of the center axis of the composite prism structure of the selected telescopic structure is adjustable. The elevation of the massaging structure 103 above the supporting surface 193 adjusts by adjusting the span of the length of each telescopic structure selected from the plurality of telescopic stanchions 102. The plurality of telescopic stanchions 102 comprises a first telescopic stanchion 111 and a second telescopic stanchion 112. The first telescopic stanchion 111 attaches to the base 101 in the manner of a cantilever. The second telescopic stanchion 112 attaches to the base 101 in the manner of a cantilever.

The first telescopic stanchion 111 is a telescopic structure that comprises a first arm 131, a second arm 132, and a first detent 141. The first detent 141 is a mechanical device that locks and secures the first arm 131 to the second arm 132. The first arm 131 is a hollow prism that is further defined with an inner dimension. The second arm 132 is a hollow prism that is further defined with an outer dimension. The second arm 132 is geometrically similar to the first arm 131. The span of the outer dimension of the first arm 131 is lesser than the span of the inner dimension of the second arm 132 such that the first arm 131 inserts into the second arm 132 in a telescopic fashion to form a composite prism structure. The span of the length of the first telescopic stanchion 111 adjusts by adjusting the relative position of the first arm 131 within the second arm 132.

The position of the second arm 132 relative to the first arm 131 is held in position using the first detent 141. The first detent 141 is selected from the group consisting of a cotter pin, a G snap collar, a cam lock collar, a threaded clutch, a split collar lock, and a spring-loaded ball lock.

The first arm 131 further comprises a first roller post 161 and a first tee handle 171.

The first roller post 161 is a mechanical structure that attaches the massaging structure 103 to the first telescopic stanchion 111 of the plurality of telescopic stanchions 102. The first roller post 161 further comprises a rotating post 181 and a locking hinge 182. The rotating post 181 further comprises a fifth arm 135 and a sixth arm 136.

The rotating post 181 is a mechanical structure that attaches the first arm 131 of the first telescopic stanchion 111 to the roller structure 121 of the plurality of telescopic stanchions 102. The rotating post 181 is a rotating structure formed such that the center axis of the prism structure of the roller structure 121 rotates in a horizontal direction towards and away from the second telescopic stanchion 112 of the plurality of telescopic stanchions 102. The locking hinge 182 is a lockable fastening structure that attaches the fifth arm 135 to the sixth arm 136 such that the sixth arm 136 rotates relative to the fifth arm 135.

The fifth arm 135 is a prism-shaped shaft structure. The fifth arm 135 is the fixed arm of the rotating post 181 structure of the first roller post 161. The fifth arm 135 attaches to the lateral face of the prism structure of the first arm 131. The fifth arm 135 projects radially away from the lateral face of the first arm 131 in a direction away from the center axis of the first arm 131.

The sixth arm 136 is a prism-shaped shaft structure. The sixth arm 136 is the rotating structure of the rotating post 181 of the first roller post 161. The sixth arm 136 rotates relative to the fifth arm 135. The sixth arm 136 attaches the rotating post 181 to the first rolling element bearing 151 of the roller structure 121 such that the center axis of the roller structure 121 rotates horizontally away from the plurality of telescopic stanchions 102.

The first tee handle 171 is a prism-shaped shaft that attaches to the end of the first arm 131 that is distal from the second arm 132. The first tee handle 171 attaches to the first arm 131 such that the center axis of the first tee handle 171 is perpendicular to the center axis of the first arm 131. The first tee handle 171 forms a grip used to carry the invention 100.

The end of the second arm 132 that is distal from the first arm 131 attaches to the base 101.

The second telescopic stanchion 112 is a telescopic structure that comprises a third arm 133, a fourth arm 134, and a second detent 142. The second detent 142 is a mechanical device that locks and secures the fourth arm 134 to the third arm 133. The third arm 133 is a hollow prism that is further defined with an inner dimension. The fourth arm 134 is a hollow prism that is further defined with an outer dimension. The fourth arm 134 is geometrically similar to the third arm 133. The span of the outer dimension of the third arm 133 is lesser than the span of the inner dimension of the fourth arm 134 such that the third arm 133 inserts into the fourth arm 134 in a telescopic fashion to form a composite prism structure. The span of the length of the second telescopic stanchion 112 adjusts by adjusting the relative position of the third arm 133 within the fourth arm 134.

The position of the third arm 133 relative to the fourth arm 134 is held in position using the second detent 142. The second detent 142 is selected from the group consisting of a cotter pin, a G snap collar, a cam lock collar, a threaded clutch, a split collar lock, and a spring-loaded ball lock.

The third arm 133 further comprises a second roller post 162 and a second tee handle 172.

The second roller post 162 is a mechanical structure that attaches the massaging structure 103 to the second telescopic stanchion 112 of the plurality of telescopic stanchions 102. The second roller post 162 further comprises a spring detent 163. The spring detent 163 is a mechanical device that attaches the rotating shaft 153 to the second roller post 162 such that the rotating shaft 153 can rotate relative to the third arm 133. The spring detent 163 allows the end of the rotating shaft 153 that is distal from the rotating post 181 to: a) securely attach the roller structure 121 to the second telescopic stanchion 112; while, b) simultaneously allowing the roller structure 121 to be removed and replaced during maintenance activities on the invention 100.

The second tee handle 172 is a prism-shaped shaft that attaches to the end of the third arm 133 that is distal from the fourth arm 134. The second tee handle 172 attaches to the third arm 133 such that the center axis of the second tee handle 172 is perpendicular to the center axis of the third arm 133. The second tee handle 172 forms a grip used to carry the invention 100.

The end of the fourth arm 134 that is distal from the third arm 133 attaches to the base 101.

The massaging structure 103 is a prism-shaped structure. The massaging structure 103 is a rotating structure. The rotation of the massaging structure 103 generates a kneading action that massages the leg 192 of the patient 191. The leg 192 rests on the superior surface of the massaging structure 103 such that the movement of the plurality of telescopic stanchions 102 rotates the massaging structure 103 which generates the kneading of the leg 192 characteristic of a massage. The massaging structure 103 comprises a roller structure 121 and a foam cushion 122.

The roller structure 121 is a prism-shaped structure. The roller structure 121 is a rotating structure. The axis of rotation of the roller structure 121 aligns with the center axis of the prism structure of the roller structure 121. The roller structure 121 attaches the foam cushion 122 to the first telescopic stanchion 111 and the second telescopic stanchion 112 of the plurality of telescopic stanchions 102. The roller structure 121 forms the rotating element of the invention 100 such that the rotation of the roller structure 121 kneads the leg 192 of the patient 191.

The roller structure 121 comprises a first rolling element bearing 151, a second rolling element bearing 152, and a rotating shaft 153.

The first rolling element bearing 151 is a commercially available bearing. The first rolling element bearing 151 attaches the sixth arm 136 to the rotating shaft 153 such that the rotating shaft 153 rotates relative to the fifth arm 135 of the rotating post 181.

The second rolling element bearing 152 is a commercially available bearing. The second rolling element bearing 152 attaches the second roller post 162 of the third arm 133 to the rotating shaft 153 such that the rotating shaft 153 rotates around an axis of rotation of the aligned with the center axis of the rotating shaft 153.

The foam cushion 122 is a polyurethane foam structure that covers the lateral face of the prism structure of the roller structure 121. The foam cushion 122 protects the leg 192 of the patient 191 from injury.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Appendage: As used in this disclosure, appendage is a generic term used to describe either the arm and/or leg of a patient.

Bearing: As used in this disclosure, a bearing is a mechanical device that: 1) guides and limits the motion of a moving component relative to a fixed component; and, 2) reduces the friction between the moving component and the fixed component. The use of bearings is well known and documented in the mechanical arts.

Carbamate: As used in this disclosure, a carbamate is a functional group consisting of an O—(C═O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a structure formed from a pad that is used to prevent injury or damage to a person or object.

Cylinder: As used in this disclosure, a cylinder is a geometric structure defined by two identical flat and parallel congruent ends, also commonly referred to as bases, which are circular in shape and connected with a single curved surface, referred to in this disclosure as the lateral face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Extension Apparatus: As used in this disclosure, an extension apparatus is a mechanical structure that is used to extend or bridge the reach between any two objects.

Foam: As used in this disclosure, foam is a mass of gas-filled spaces, commonly referred to as bubbles, which can be formed: 1) on or in a liquid or gel; or, 2) in a solid material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Kneading: As used in this disclosure, to knead refers to the folding, pressing a stretching of a collection of materials for the purpose of forming a uniform mass. The term kneading may further refer to a motion similar to the kneading motion that is used during massage activities.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Massage: As used in this disclosure, a massage is a therapeutic process wherein the muscles of the body are kneaded for the purpose of aiding circulation and relaxing the muscles.

Monomer: As used in this disclosure, a monomer refers to a molecular structure that bonds to itself in a repeating manner to form a polymer.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Patient: As used in this disclosure, a patient is a person who is designated to receive a medical treatment, therapy or service. The term patient may be extended to an animal when used within the context of the animal receiving veterinary treatment or services.

Pedestal: As used in this disclosure, a pedestal is an intermediary load bearing structure that that transfers a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Roll: As used in this disclosure, the term roll refers to the rotation of an object around an axis or center of rotation.

Roller: As used in this disclosure, a roller is rotating cylindrical or disk structure used to reduce the friction of movement of an object supported by the roller. A roller will often change the direction of a cord or sheeting.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk-shaped. A rolling element bearing is said to be "locking" when the relative position of the inner race is locked into a fixed position relative to the outer race. Rolling element bearings, including locking versions, are: 1) commercially available; and, 2) well-known and documented in the mechanical arts.

Rotation: As used in this disclosure, rotation refers to the cyclic movement of an object around a fixed point or fixed axis. The verb of rotation is to rotate.

Shaft: As used in this disclosure, the term shaft is used to describe a rigid prism that is often used as the handle of a tool or implement. The terms inner dimension of the shaft and outer dimension of the shaft are used as they would be used by those skilled in the plumbing arts. The definition of shaft explicitly includes solid shafts or shafts that are formed more like pipes with a hollow passage through the shaft that runs along the center axis of the shaft prism.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Tee Shape: As used in this disclosure, the term see shape refers to a structure formed from a cross prism and a cantilever prism wherein the cantilever prism attaches to the cross prism such that: a) the cantilever prism attaches to the cross prism in the manner of a cantilever; and, b) the center axis of the cantilever prism intersects with a projects radially away from the center point of the center axis of the cross prism.

Telescopic: As used in this disclosure, telescopic is an adjective that describes an object made of sections that fit or slide into each other such that the object can be made longer or shorter by adjusting the relative positions of the sections.

Therapeutic: As used in this disclosure, therapeutic is an adjective that refers to a medical, ameliorative, or hygienic substance, process, or procedure.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic device comprising:

a base, a plurality of telescopic stanchions, and a massaging structure;

wherein the massaging structure and the base attach to the plurality of telescopic stanchions;

wherein the plurality of telescopic stanchions elevate the massaging structure above a supporting surface;

wherein the therapeutic device is adapted for use with a patient;

wherein the therapeutic device massages a leg of the patient;

wherein the massaging structure rotates such that the rotation of the massaging structure massages the leg of the patient;

wherein the massaging structure comprises a roller structure and a foam cushion;

wherein the roller structure is a prism-shaped structure;

wherein the roller structure is a rotating structure;

wherein the foam cushion covers a lateral face of the prism-shaped structure of the roller structure;

wherein the roller structure comprises a first rolling element bearing, a second rolling element bearing, and a rotating shaft;

wherein the first rolling element bearing attaches a sixth arm to the rotating shaft such that the rotating shaft rotates relative to a fifth arm of a rotating post;

wherein the second rolling element bearing attaches a second roller post of a third arm to the rotating shaft such that the rotating shaft rotates around an axis of rotation with a center axis of the rotating shaft.

2. The therapeutic device according to claim 1 wherein the base is a pedestal;

wherein the base forms the final link of the load path between the massaging structure and the supporting surface.

3. The therapeutic device according to claim 2 wherein the plurality of telescopic stanchions is an extension apparatus;

wherein each of the plurality of telescopic stanchions is identical;

wherein each of the plurality of telescopic stanchions is a composite prism structure.

4. The therapeutic device according to claim 3 wherein each telescopic structure selected from the plurality of telescopic stanchions is adjustable such that the span of the length of the center axis of the composite prism structure of the selected telescopic structure is adjustable;

wherein the elevation of the massaging structure above the supporting surface adjusts by adjusting the span of the length of each telescopic structure selected from the plurality of telescopic stanchions.

5. The therapeutic device according to claim 4 wherein the massaging structure is a prism-shaped structure;

wherein the massaging structure is a rotating structure;

wherein the rotation of the massaging structure generates a kneading action;

wherein the leg rests on the superior surface of the massaging structure such that the movement of the plurality of telescopic stanchions rotates the massaging structure which generates a kneading of the leg characteristic of a massage.

6. The therapeutic device according to claim 5 wherein the plurality of telescopic stanchions comprises a first telescopic stanchion and a second telescopic stanchion;

wherein the first telescopic stanchion attaches to the base in the manner of a cantilever;

wherein the second telescopic stanchion attaches to the base in the manner of a cantilever.

7. The therapeutic device according to claim 6 wherein the axis of rotation of the roller structure aligns with the center axis of the prism structure of the roller structure;

wherein the roller structure attaches the foam cushion to the first telescopic stanchion and the second telescopic stanchion of the plurality of telescopic stanchions.

8. The therapeutic device according to claim 7 wherein the first telescopic stanchion is a telescopic structure that comprises a first arm, a second arm, and a first detent;

wherein the second telescopic stanchion is a telescopic structure that comprises the third arm, a fourth arm, and a second detent;

wherein the first detent is a mechanical device that locks and secures the first arm to the second arm;

wherein the second detent is a mechanical device that locks and secures the third arm to the fourth arm.

9. The therapeutic device according to claim 8 wherein the first arm is a hollow prism that is further defined with an inner dimension;

wherein the second arm is a hollow prism that is further defined with an outer dimension;

wherein the second arm is geometrically similar to the first arm;

wherein the span of the outer dimension of the first arm is lesser than the span of the inner dimension of the second arm such that the first arm inserts into the second arm in a telescopic fashion to form a composite prism structure;

wherein the position of the second arm relative to the first arm is held in position using the first detent.

10. The therapeutic device according to claim 9 wherein the third arm is a hollow prism that is further defined with an inner dimension;

wherein the fourth arm is a hollow prism that is further defined with an outer dimension;

wherein the fourth arm is geometrically similar to the third arm;

wherein the span of the outer dimension of the third arm is lesser than the span of the inner dimension of the fourth arm such that the third arm inserts into the fourth arm in a telescopic fashion to form a composite prism structure;

wherein the span of the length of the second telescopic stanchion adjusts by adjusting the relative position of the third arm within the fourth arm;

wherein the position of the third arm relative to the fourth arm is held in position using the second detent.

11. The therapeutic device according to claim 10 wherein the end of the second arm that is distal from the first arm attaches to the base;

wherein the end of the fourth arm that is distal from the third arm attaches to the base.

12. The therapeutic device according to claim 11 wherein the first arm further comprises a first roller post and a first tee handle;

wherein the first roller post is a mechanical structure that attaches the massaging structure to the first telescopic stanchion of the plurality of telescopic stanchions;

wherein the first tee handle is a prism-shaped shaft that attaches to the end of the first arm that is distal from the second arm;

wherein the first tee handle forms a grip used to carry the therapeutic device.

13. The therapeutic device according to claim 12 wherein the third arm further comprises a second roller post and a second tee handle;

wherein the second roller post is a mechanical structure that attaches the massaging structure to the second telescopic stanchion of the plurality of telescopic stanchions;

wherein the second tee handle is a prism-shaped shaft that attaches to the end of the third arm that is distal from the fourth arm;

wherein the second tee handle forms a grip used to carry the therapeutic device.

14. The therapeutic device according to claim 13 wherein the first roller post further comprises the rotating post and a locking hinge;

wherein the rotating post further comprises a fifth arm and a sixth arm;

wherein the rotating post is a mechanical structure that attaches the first arm of the first telescopic stanchion to the roller structure of the plurality of telescopic stanchions;

wherein the rotating post is a rotating structure formed such that the center axis of the prism structure of the roller structure rotates in a horizontal direction towards and away from the second telescopic stanchion of the plurality of telescopic stanchions;

wherein the locking hinge is a lockable fastening structure that attaches the fifth arm to the sixth arm such that the sixth arm rotates relative to the fifth arm;

wherein the fifth arm is a prism-shaped shaft structure;

wherein the fifth arm is the fixed arm of the rotating post structure of the first roller post;

wherein the fifth arm attaches to the lateral face of the prism structure of the first arm;

wherein the fifth arm projects radially away from the lateral face of the first arm in a direction away from the center axis of the first arm;

wherein the sixth arm is a prism-shaped shaft structure;

wherein the sixth arm is the rotating structure of the rotating post of the first roller post;

wherein the sixth arm rotates relative to the fifth arm;

wherein the sixth arm attaches the rotating post to the first rolling element bearing of the roller structure such that the center axis of the roller structure rotates horizontally away from the plurality of telescopic stanchions.

15. The therapeutic device according to claim 14 wherein the second roller post further comprises a spring detent;

wherein the spring detent is a mechanical device that attaches the rotating shaft to the second roller post such that the rotating shaft can rotate relative to the third arm;

wherein the spring detent allows the end of the rotating shaft that is distal from the rotating post to: a) securely attach the roller structure to the second telescopic stanchion; while, b) simultaneously allowing the roller structure to be removed and replaced during maintenance activities on the therapeutic device.

16. The therapeutic device according to claim 15 wherein the first tee handle attaches to the first arm such that the center axis of the first tee handle is perpendicular to the center axis of the first arm;

wherein the second tee handle attaches to the third arm such that the center axis of the second tee handle is perpendicular to the center axis of the third arm.

17. The therapeutic device according to claim 16 wherein the base is an openwork structure;

wherein the base has a rectangular shape.

18. The therapeutic device according to claim 17 wherein the foam cushion is a polyurethane foam structure.

* * * * *